US006378164B1

(12) United States Patent
Berfield

(10) Patent No.: US 6,378,164 B1
(45) Date of Patent: Apr. 30, 2002

(54) PUMP INLET FITTING

(75) Inventor: Robert C. Berfield, Jersey Shore, PA (US)

(73) Assignee: Shop Vac Corporation, Williamsport, PA (US)

( * ) Notice: Subject to any disclaimer, the term of this patent is extended or adjusted under 35 U.S.C. 154(b) by 0 days.

(21) Appl. No.: 09/618,657

(22) Filed: Jul. 18, 2000

(51) Int. Cl.[7] ..... C47L 5/12
(52) U.S. Cl. ..... 15/353; 417/423.9; 417/423.2
(58) Field of Search ..... 15/353; 417/423.9, 417/423.2, 313; 415/121.2

(56) References Cited

U.S. PATENT DOCUMENTS

| | | | | |
|---|---|---|---|---|
| 1,661,480 A | | 3/1928 | Keefer | 15/321 |
| 1,691,164 A | | 11/1928 | Monk | 15/321 |
| 1,982,345 A | | 11/1934 | Kirby | 15/321 |
| 4,080,104 A | | 3/1978 | Brown, Jr. | 417/17 |
| 4,179,768 A | | 12/1979 | Sawyer | 15/352 |
| 4,246,676 A | | 1/1981 | Hallsworth et al. | 15/353 |
| 4,723,337 A | | 2/1988 | Ellison et al. | 15/300 |
| 5,287,590 A | | 2/1994 | Yonkers et al. | 15/321 |
| 5,349,722 A | | 9/1994 | Chayer | 15/353 |
| 5,465,455 A | | 11/1995 | Allen | 15/319 |
| 5,555,597 A | | 9/1996 | Berfield | 15/321 |
| 5,715,568 A | | 2/1998 | Berfield et al. | 15/353 |
| 5,850,668 A | | 12/1998 | Berfield et al. | 15/353 |
| 5,860,796 A | * | 1/1999 | Clausen | 417/423.9 |
| 5,918,344 A | | 7/1999 | Crevling, Jr. et al. | 15/339 |
| 5,920,955 A | | 7/1999 | Berfield | 15/352 |
| 5,966,775 A | | 10/1999 | Berfield | 15/353 |
| 6,009,596 A | | 1/2000 | Buss et al. | 15/353 |
| 6,049,940 A | | 4/2000 | Robitaille | 15/319 |
| 6,069,330 A | | 5/2000 | Crevling, Jr. et al. | 200/84 |
| 6,079,076 A | | 6/2000 | Berfield | 15/321 |
| 6,112,366 A | | 9/2000 | Berfield | 15/352 |
| 6,119,304 A | | 9/2000 | Berfield et al. | 15/353 |
| 6,179,558 B1 | * | 1/2001 | Eastman, III et al. | 417/423.9 |

* cited by examiner

*Primary Examiner*—Robert J. Warden, Sr.
*Assistant Examiner*—Theresa T. Snider
(74) *Attorney, Agent, or Firm*—Marshall, Gerstein & Borun

(57) ABSTRACT

A pump inlet fitting for a wet/dry vacuum cleaner is disclosed. The pump inlet fitting frictionally attaches a pump inlet assembly to an inner surface of an intake tube of a wet/dry vacuum cleaner. The pump inlet fitting includes a plurality of radially extending barbs which frictionally engage the inner surface of the intake tube to a degree sufficient to secure the pump inlet assembly to the intake tube without the need for costly and time consuming external clamping mechanisms.

20 Claims, 5 Drawing Sheets

PUMP INLET FITTING

FIELD OF THE INVENTION

The invention generally relates to wet/dry vacuum cleaners, and more particulary relates to inlet fittings for wet/dry vacuum cleaners which include pumping capability.

BACKGROUND OF THE INVENTION

Wet/dry vacuum cleaners are well known. Such devices typically include a large reservoir or tank having a bottom and an annular side wall to which a lid is attached to enclose the tank. A motor-driven impeller and other mechanics associated with creation of a vacuum are typically mounted within the lid with a flexible hose being mountable to an inlet to the vacuum. Debris, including solids, liquids, and gases, are drawn in by the vacuum and deposited into the tank. When the tank is full, the lid needs to be removed to dump the debris gathered within the tank. However, the weight of the tank and collected debris can be substantial, often preventing lifting of the tank or even tilting of the tank to empty its contents.

Recently, wet/dry vacuum cleaners have been provided which also include a pumping capability. Therefore, in addition to being able to draw matter into the tank, such devices include a mechanism by which the fluid within the tank can be expelled under power without the need of removing the lid to the tank and lifting or tilting the tank. Examples of such devices are disclosed in U.S. Pat. No. 6,009,596, assigned to the present assignee and expressly incorporated herein by reference. Other examples are disclosed in pending U.S. patent application Ser. Nos. 09/513,607, and 09/589,492, both of which are assigned to the present assignee and expressly incorporated herein by reference.

In wet/dry vacuum cleaners having a pump located within a lid of the device, an intake tube typically extends downwardly from the pump into the tank. A pump inlet assembly is typically attached to the base of the intake tube to provide a mechanism by which the pump can be primed, as well as a mechanism through which the fluid being pumped can be filtered. With typical prior art designs, the filter intake assembly is secured to the end of the intake tube using conventional band clamps. The pump inlet assembly is secured around the outer surface of the intake tube with the band clamp then being secured around the outer surface of the pump inlet assembly. While effective, such a design has proven to be less than ideal for assembly and reliability purposes.

SUMMARY OF INVENTION

In accordance with one aspect of the invention, a wet/dry vacuum cleaner pump inlet assembly is provided which is adapted to be mounted to an inlet tube within a tank of a wet/dry vacuum cleaner. The pump inlet assembly includes an inlet housing and an inlet fitting. The inlet housing includes the top plate and an annular wall extending from the top plate. The top plate also includes an opening for receipt of the inlet tube. The inlet fitting includes a bottom plate and a mounting leg extending from the bottom plate. The bottom plate is frictionally secured to the inlet housing annular wall, and the mounting leg is frictionally secured to an inner surface of the inlet tube.

In accordance with another aspect of the invention, a wet/dry vacuum cleaner pump inlet fitting is provided for a wet/dry vacuum cleaner having a pump adapted to expel liquid from a tank of the vacuum cleaner. The pump inlet fitting comprises a base, a leg extending from the base, and a plurality of barbs radially extending from the leg. The barbs are adapted to frictionally engage an inner surface of an intake tube of the pump in order to secure the fitting to the intake tube.

In accordance with another aspect of the invention, a wet/dry vacuum cleaner is provided which comprises a tank, a vacuum source mounted on the tank to draw fluid into the tank, a pump mounted on the tank to expel fluid from the tank, an intake tube extending from the pump into the tank, and an inlet assembly mounted on the intake tube. The inlet assembly includes a filter such that fluid to be expelled from the tank is drawn through the filter, into the inlet assembly, and through the intake tube. The inlet assembly is frictionally mounted to an inner surface of the intake tube.

These and other aspects and features of the invention will become more apparent from the following detailed description when taken in conjunction with the accompanying drawings.

Figure 1:
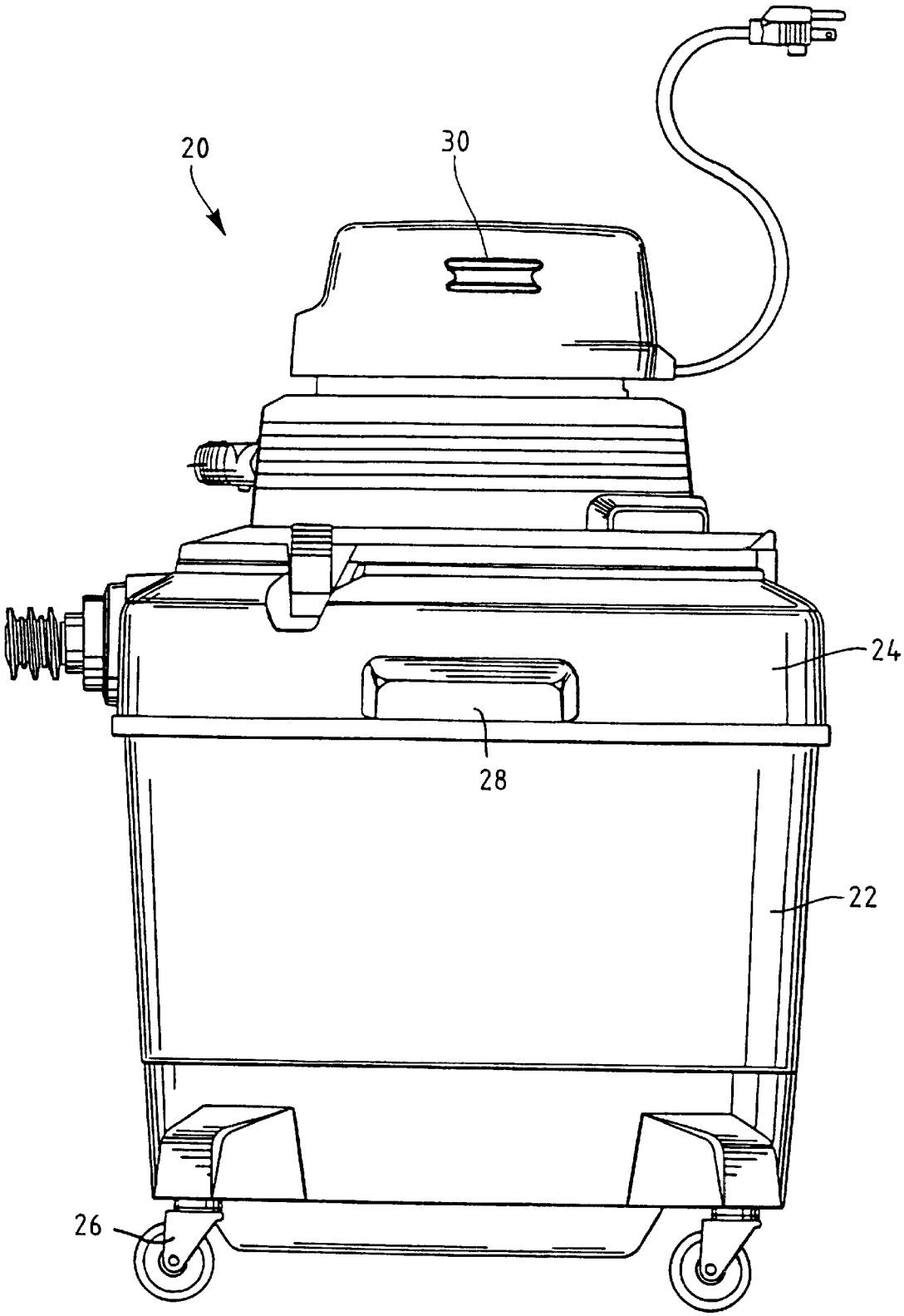
FIG. 1 is a side view of a wet/dry vacuum cleaner constructed in accordance with the teachings of the invention.

While the invention is susceptible to various modifications and alternative instructions, certain illustrative embodiments thereof have been shown in the drawings and will be described below in detail. It should be understood, however, that there is no intention to limit the invention to the specific forms disclosed, but on the contrary, the intention is to cover all modifications, alternative instructions and equivalents falling within the spirit and scope of the invention as defined by the appended claims.

DETAILED DESCRIPTION OF THE PREFERRED EMBODIMENTS

Referring now to the drawings, and with specific reference to FIG. 1, a wet/dry vacuum cleaner constructed in accordance with the teachings of the invention is generally depicted by reference numeral 20. While the invention is described and illustrated in conjunction with the wet/dry vacuum cleaner 20, is to be understood that the teachings of the invention can be employed with other types of vacuum cleaners, as well as other types of pumps, wherein quick attachment of inlet fittings is desirable.

As shown in FIG. 1, the vacuum cleaner 20 includes a base 22 to which a lid 24 is attached. The base 22 may include a plurality of casters 26 to facilitate movement of the vacuum cleaner 20. The lid 24 may include a pair of handles 28 to facilitate removal of the lid 24, as well as lifting of the vacuum cleaner 20.

Figure 2:
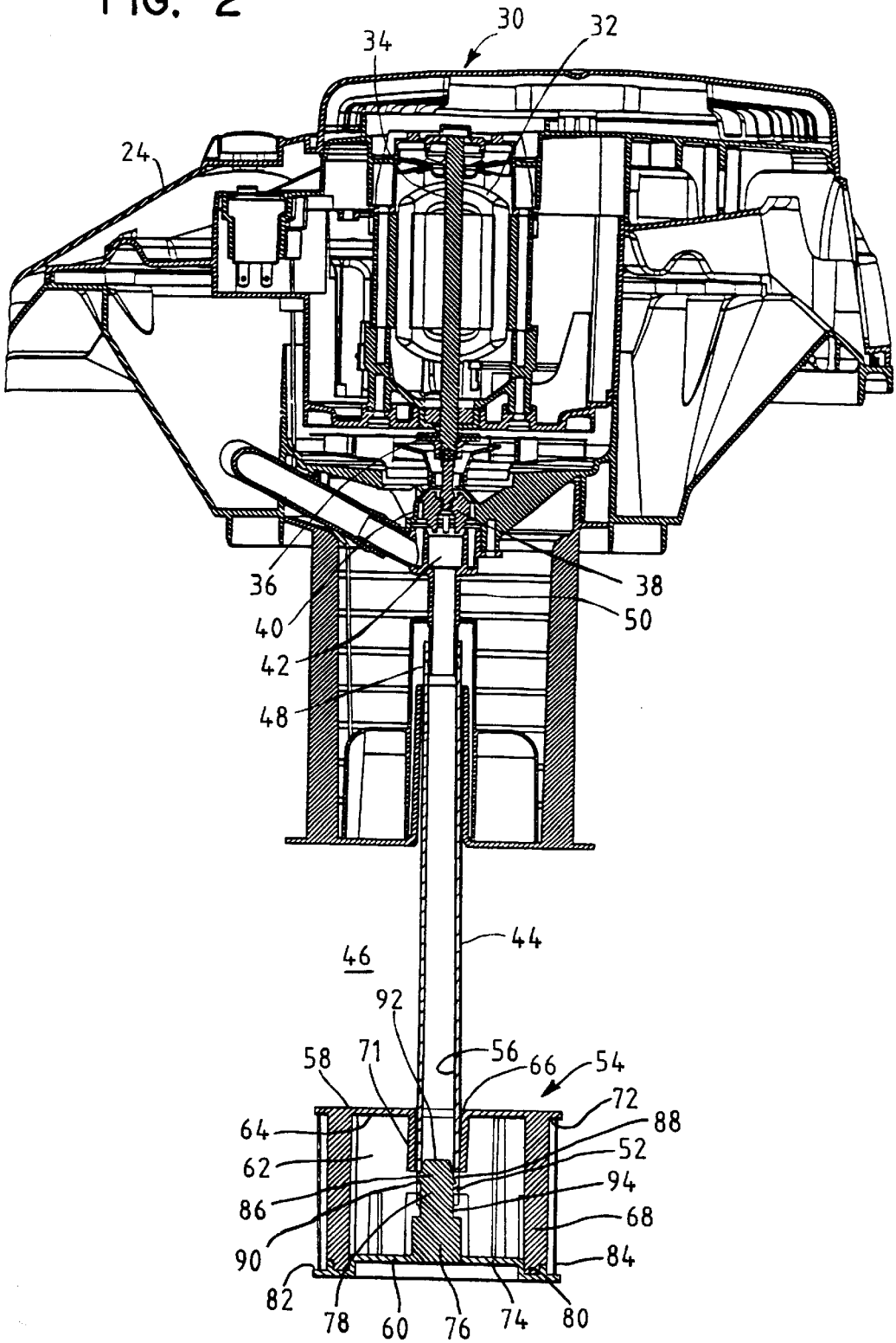
FIG. 2 is a sectional view of FIG. 1 taken general at along line 2—2 of FIG. 1.

Referring now to FIG. 2, a power assembly 30 is shown mounted in the lid 24. The power assembly 30 includes a motor 32 connected by a shaft 34 to a vacuum impeller 36, as well as a pump impeller 38. As described in pending applications of the present assignee, the vacuum cleaner 20 can be operated to take advantage of either the vacuum impeller 36 or only the pump impeller 38. The present invention is directed to operation in a pumping mode.

The pump impeller 38 is mounted for rotation within a pump housing 40 which includes an inlet 42. An intake tube 44 extends from the inlet 42 downwardly into a reservoir or tank space 46 defined by the base 22. The intake tube 44 includes an upper end 48 which is preferably dimensioned to frictionally mount to a stub 50 associated with the inlet 42 to facilitate easy attachment when operating the vacuum cleaner 20 in a pump mode.

The intake tube 44 also includes a lower end 52 to which a pump inlet assembly 54 is attached. As will be described in further detail herein, the pump inlet assembly 54 is adapted to frictionally mount to an inner surface 56 of the intake tube 44.

Figure 3:
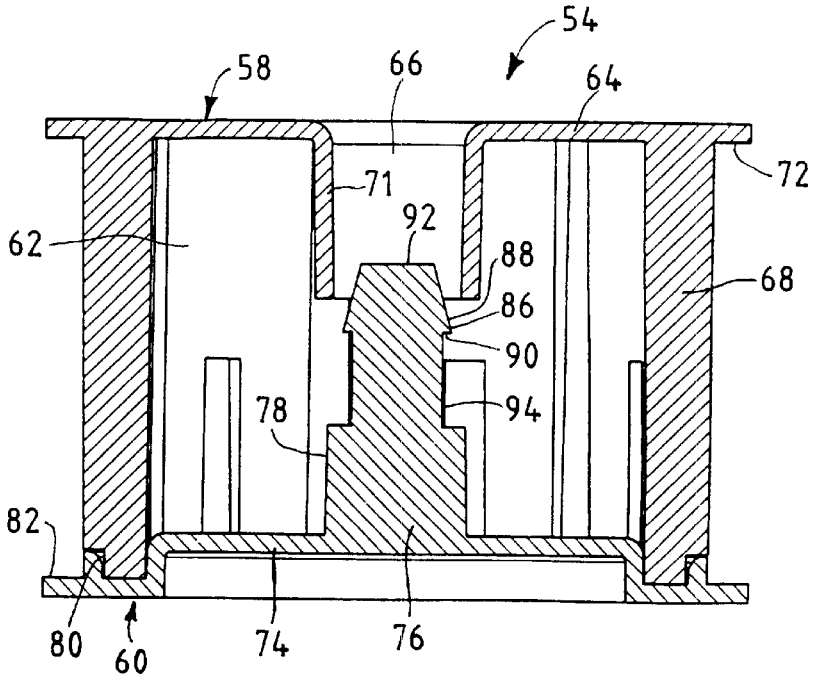
FIG. 3 is an enlarged sectional view of the pump inlet assembly of FIG. 2.
Figure 4:
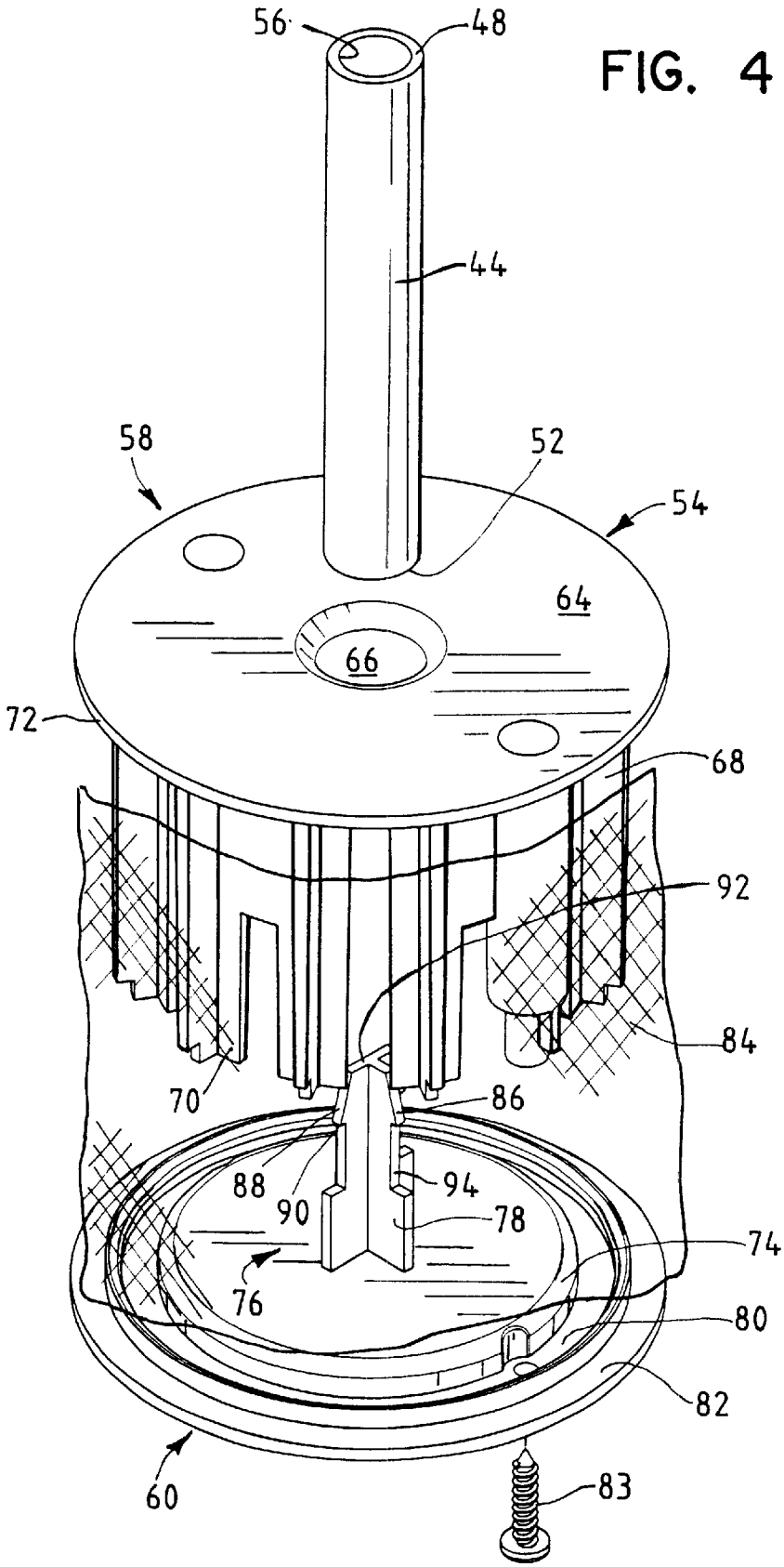
FIG. 4 is an exploded view of the pump inlet assembly constructed in accordance with the teachings of the invention.

Referring now to FIGS. 3 and 4, the pump inlet assembly 54 is shown in detail. The pump inlet assembly 54 includes an inlet housing 58, as well as an inlet fitting 60. The inlet housing 58 and inlet fitting 60, when mounted together, cooperate to form inlet space 62 in fluid communication with the intake tube 44 and thus the pump housing 40.

The inlet housing 58 includes a top plate 64 having a central aperture 66 and an annular wall 68. The annular wall 68 is formed from multiple portions 70 (see FIG. 4), or is otherwise imperforate, to allow for fluid communication therethrough. A mounting lip 71 downwardly extends from the top plate 64 proximate the central aperture 66. The annular wall 68 is slightly less in diameter than the diameter of the top plate 64 such that an annular flange 72 is formed.

Figure 5:
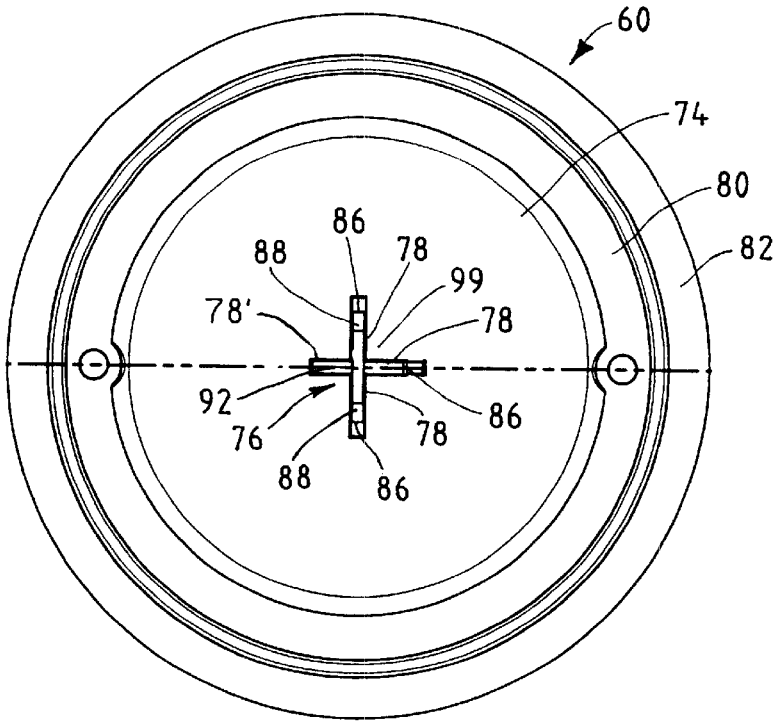
FIG. 5 is a top view of a pump inlet fitting constructed in accordance with the teachings of the invention.

With reference now to FIGS. 3–5, the pump inlet fitting 60 is shown to include a bottom plate or base 74 from which a mounting leg 76 upwardly extends. As shown best in FIG. 5, the mounting leg 76 preferably includes four walls 78 which extend radially outwardly and are spaced approximately ninety degrees apart. The bottom plate 74 includes a circumferential recess 80 radially inward of a flange 82. As shown best in FIG. 3, the annular wall 68 of the inlet housing 58 is frictionally received within the recess 80 to connect the inlet housing 58 to the inlet fitting 60. Fasteners 83 (FIG. 4) may be used to further secure the inlet housing 58 to the inlet fitting 60. Additionally shown in FIG. 3, the flange 82 of the inlet fitting 60 cooperates with the flange 72 of the inlet housing 58 to secure a filter element or medium 84 (FIG. 2) therebetween. The filter element 84 is preferably annular in shape to surround the annular wall 68 and is manufactured from a suitable material to screen large particles from fluid passing from the tank 46 into the inlet space 62.

As shown in FIGS. 3–5, certain of the walls 78 include barbs 86 to facilitate frictional interference between the mounting leg 76 and the inner surface 56 of the intake tube 44. The barbs 86 are formed at a juncture between a canted surface 88 and a shoulder 90. The canted surface 88 tapers radially outwardly from a reduced diameter end 92 of the mounting leg 76 to the shoulder 90. The shoulder 90 extends radially outwardly from a reduced diameter recess 94 to the canted surface 88.

In the preferred embodiment, three of the four walls 78 are provided with barbs 86. The fourth wall 78' (see FIG. 6) includes an angled top surface 96 and a uniform diameter side surface 98, with no barb 86 being provided.

In operation, it will be appreciated that the invention provides a quick and straightforward mechanism by which the inlet assembly 54 can be secured to the intake tube 44. As a result, the time and labor involved in assembling the inlet assembly 54 is greatly reduced. More specifically, the intake tube 44 is secured to the stub 50, and the inlet assembly 54 is secured to the lower end 52 of the intake tube 44 simply by inserting the mounting leg 76 of the inlet fitting 60 into the intake tube 44. The canted surfaces 88 of the wall 78 facilitate sliding insertion action and centering of the mounting leg 76 within the intake tube 44. Once the mounting leg 76 is inserted into the intake tube 44 to a degree sufficient to allow the shoulder 90 to pass the lower end 52, the barbs 86 frictionally grip the inner surface 56 of the intake tube 44. The frictional interference between the barbs 86 and the inner surface 56 sufficiently secure the pump inlet assembly 54 to the intake tube 44 to negate the need for external fastening mechanisms, including metal band clamps, employed by prior art devices. When inserted, the four walls 78 cooperate with the intake tube 44 to define four intake quadrants 99 through which fluid may pass.

Figure 6:
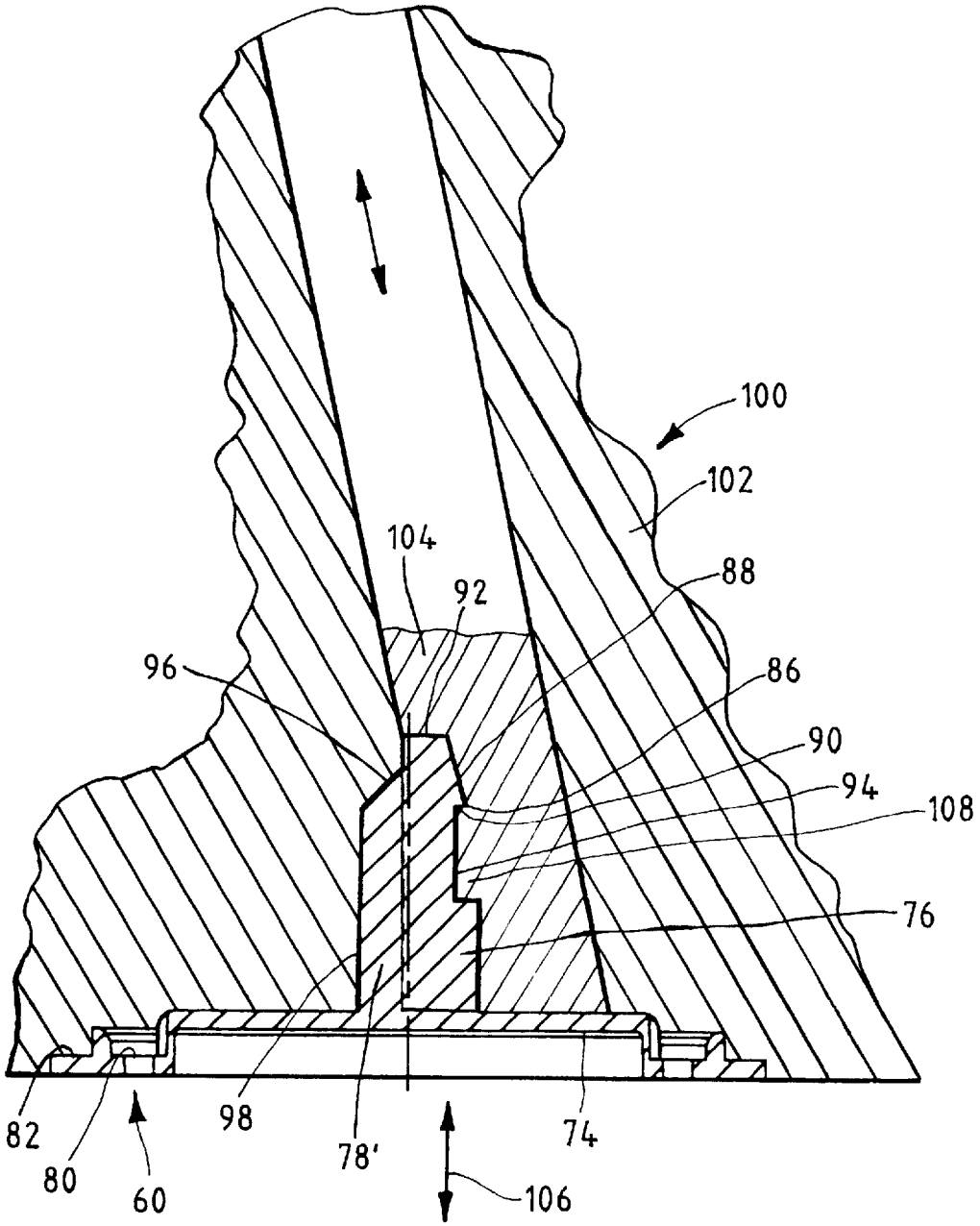
FIG. 6 is a cut-away sectional view of the pump inlet fitting and mold used in constructing the pump inlet fitting.

Referring now to FIG. 6, a portion of a mold 100 used for manufacturing the inlet fitting 60 is partially depicted. The inlet fitting 60, as well as the inlet housing 58 is preferably manufactured from injection molded plastic. In order to manufacture the barbs 86 in the walls 78, the mold 100 includes an outer member 102, as well as a moveable jiggle pin 104. A separate base mold member would be employed to form the bottom plate or base 74, and is not depicted in FIG. 6. However, once the bottom mold member is removed, the inlet fitting 60 can be pulled away from the outer mold member 102 with the jiggle pin 104 moving with the inlet fitting 60 in the direction indicated by an arrow 106. Once the jiggle pin 104 is moved sufficiently away from the mold member 102, the barbs 86 are freed from frictional interference with a jog 108 formed in the jiggle pin 104, thus freeing the inlet fitting 60 from the mold 100. In order to allow for removal of the inlet fitting 60 from the mold 100, not all of the walls 78 include the barbs 86, with only three of the four walls 78 including such barbs 86 in the depicted embodiment.

From the foregoing, one of ordinary skill in the art will appreciate that the invention provides a pump inlet housing and pump inlet fitting which easily and quickly enables an operator to attach a pump inlet assembly to a pump intake tube.

What is claimed is:

1. A wet/dry vacuum cleaner pump inlet assembly, the pump inlet assembly adapted to be mounted to an inlet tube within a tank of a wet/dry vacuum cleaner, the pump inlet assembly comprising:

an inlet housing, the inlet housing including a top plate and an annular wall extending from the top plate, the top plate including an opening for receipt of the inlet tube; and an inlet fitting, the inlet fitting including a bottom plate and a mounting leg extending from the bottom plate, the bottom plate being frictionally secured to the annular wall, the mounting leg being frictionally securable to an inner surface of the inlet tube.

2. The wet/dry vacuum cleaner pump inlet assembly of claim 1 further including a filter medium secured around the annular wall, the annular wall being imperforate, fluid being able to pass through the filter medium and imperforate annular wall to an inlet area defined by the top plate, bottom plate, and the annular wall.

3. The wet/dry vacuum cleaner pump inlet assembly of claim 2 wherein the inlet fitting includes a circumferential groove adapted to frictionally receive the annular wall.

4. The wet/dry vacuum cleaner pump inlet assembly of claim 1 wherein the mounting leg includes a plurality of barbs radially extending therefrom, each of the barbs frictionally engaging the inner surface of the inlet tube.

5. The wet/dry vacuum cleaner pump inlet assembly of claim 4 wherein three and wherein the plurality of barbs are three in number a rib also radially extends from the leg, the barbs and rib cooperating with the inner surface of the intake tube to define four inlet quadrants within the intake tube.

6. The wet/dry vacuum cleaner pump inlet assembly of claim 5 wherein each barb includes a canted surface and a reduced diameter surface separated by a shoulder, the canted surface tapering radially outwardly from an end of the mounting leg to the shoulder and terminating in an engagement tooth, the canted surface facilitating insertion of the mounting leg into the inlet tube, the engagement tooth hindering removal of the mounting leg from the inlet tube.

7. The wet/dry vacuum cleaner pump inlet assembly of claim 1 wherein the inlet fitting is a unitary molded element.

8. A wet/dry vacuum cleaner pump inlet fitting, the wet/dry vacuum cleaner having a pump adapted to expel liquid from a tank of the vacuum cleaner, the pump including an intake tube, the pump inlet fitting comprising:

a base;

a leg extending away from the base; and a plurality of barbs radially extending from the leg, the barbs being adapted to frictionally engage an inner surface of the intake tube to secure the fitting to the tube.

9. The pump inlet fitting of claim 8 wherein the barbs radially extend from the leg and wherein the fitting further includes a rib radially extending from the leg, the rib and the barbs being spaced approximately ninety degrees apart.

10. The pump inlet fitting of claim 8 wherein the base, leg and plurality of barbs are integrally molded together.

11. The pump inlet fitting at claim 8 wherein each barb includes a canted surface, each canted surface extending from a reduced diameter end of the leg to an enlarged diameter shoulder.

12. The pump inlet fitting of claim 8 wherein the base includes a circumferential recess adapted to receive a lip of a pump intake housing, the pump intake housing includes a first circumferential flange, and the fitting includes a second circumferential flange, the first and second circumferential flanges being adapted to cooperatively support an annular filter element therebetween.

13. A wet/dry vacuum cleaner, comprising:

a tank;

a vacuum source mounted on the tank to draw fluid into the tank;

a pump mounted on the tank to expel fluid from the tank;

an intake tube extending from the pump into the tank; and an inlet assembly mounted on the intake tube, the inlet assembly including a filter, fluid to be expelled from the tank being drawn through the filter, into the inlet assembly and through the intake tube, the inlet assembly being frictionally mounted to an inner surface of the intake tube.

14. The wet/dry vacuum cleaner of claim 13 wherein the inlet assembly includes first and second mating housing elements, the first mating housing element including a top plate and an annular wall, the second mating housing element including a bottom plate and a mounting leg, the intake tube extending through the top plate, the mounting leg frictionally engaging the inner surface of the intake tube.

15. The wet/dry vacuum cleaner of claim 14 wherein the mounting leg includes a plurality of radially extending walls, at least one of the walls including an engagement barb frictionally engaging the inner surface of the intake tube.

16. The wet/dry vacuum cleaner of claim 15 wherein the engagement barb is formed at a junction between a canted surface and a radially extending shoulder, the canted surface tapering radially outwardly from an end of the leg to the engagement barb.

17. The wet/dry vacuum cleaner of claim 16 wherein the mounting leg includes four walls, three of the walls including an engagement barb.

18. The wet/dry vacuum cleaner of claim 14 wherein the second mating housing element includes a circumferential groove, the annular wall of the first housing element being frictionally secured to the circumferential groove.

19. The wet/dry vacuum cleaner of claim 14 wherein the filter is annular and seated around the annular wall between the top and bottom plates.

20. The wet/dry vacuum cleaner of claim 14 wherein the second mating housing element is a unitary molded element.

* * * * *